US011392063B2

(12) United States Patent
Ohwada

(10) Patent No.: US 11,392,063 B2
(45) Date of Patent: Jul. 19, 2022

(54) IMAGING SYSTEM WITH CLEANING MEMBER FOR ENDLESS BELT

(71) Applicant: Hewlett-Packard Development Company, L.P., Spring, TX (US)

(72) Inventor: Satoshi Ohwada, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/414,986

(22) PCT Filed: Jan. 17, 2020

(86) PCT No.: PCT/US2020/014095
§ 371 (c)(1),
(2) Date: Jun. 17, 2021

(87) PCT Pub. No.: WO2020/185305
PCT Pub. Date: Sep. 17, 2020

(65) Prior Publication Data

US 2022/0066360 A1 Mar. 3, 2022

(30) Foreign Application Priority Data

Mar. 14, 2019 (JP) ..... JP2019-047400

(51) Int. Cl.
*G03G 15/20* (2006.01)
*G03G 15/00* (2006.01)

(52) U.S. Cl.
CPC ..... *G03G 15/2021* (2013.01); *G03G 15/2025* (2013.01); *G03G 15/6576* (2013.01)

(58) Field of Classification Search
CPC ..... G03G 15/2021; G03G 15/2025; G03G 15/6576
See application file for complete search history.

(56) References Cited

U.S. PATENT DOCUMENTS 9,008,559 B2 4/2015 Adachi et al.
2002/0044806 A1* 4/2002 Hayashi ..... G03G 15/2064 399/327
2002/0159801 A1* 10/2002 Nakashima ..... G03G 15/162 399/249
2006/0045590 A1* 3/2006 Yamada ..... G03G 15/2053 399/329
2007/0048035 A1 3/2007 Baba et al.
2011/0188904 A1* 8/2011 Kageyama ..... G03G 15/20 399/323

(Continued)

FOREIGN PATENT DOCUMENTS

JP 1996-334997 12/1996
JP 1997258562 10/1997

(Continued)

*Primary Examiner* — Susan S Lee
(74) *Attorney, Agent, or Firm* — Jefferson IP Law, LLP

(57) ABSTRACT

An imaging system includes: an endless belt, a tensioning member, a heating member, a pressing member, a cleaning member. The endless belt conveys a printing medium. The tensioning member tensions the endless belt. The heating member heats the endless belt. The pressing member presses the endless belt against the heating member. The cleaning member is located outside the endless belt, between the tensioning member and the heating member, and presses the endless belt inwardly.

20 Claims, 16 Drawing Sheets

(56) References Cited

U.S. PATENT DOCUMENTS

2015/0323892 A1* 11/2015 Sakamaki ..... G03G 15/2017
399/327

FOREIGN PATENT DOCUMENTS

| | | | | |
|---|---|---|---|---|
| JP | 2000075750 | A | | 3/2000 |
| JP | 2002268404 | | | 9/2002 |
| JP | 2003122185 | A | * | 4/2003 |
| JP | 2003-302857 | | | 10/2003 |
| JP | 2005-156769 | | | 6/2005 |
| JP | 2007121384 | A | * | 5/2007 |
| JP | 2008-170649 | | | 7/2008 |
| JP | 2012014046 | | | 1/2012 |
| JP | 2013050664 | | | 3/2013 |
| JP | 2013109057 | A | | 6/2013 |

* cited by examiner

IMAGING SYSTEM WITH CLEANING MEMBER FOR ENDLESS BELT

BACKGROUND

Some imaging systems include a gloss control device which controls gloss of a toner image formed on a printing medium. The gloss control device includes an endless belt which conveys a printing medium, a heating roller which heats the endless belt, a pressing roller which presses the endless belt against the heating roller, and a cooling structure which cools the endless belt having passed between the heating roller and the pressing roller. The printing medium which is conveyed on the endless belt passes between the heating roller and the pressing roller to be heated and pressed and is cooled by the cooling structure.

DETAILED DESCRIPTION

In the following description, with reference to the drawings, the same reference numbers are assigned to the same components or to similar components having the same function, and overlapping description is omitted.

An imaging system may include various devices relating to an imaging operation. In some examples, an imaging system may include an imaging apparatus such as a printer. In some examples, an imaging system may include a gloss control device to be mounted in or to be operable with an imaging apparatus. An example imaging system includes both an imaging apparatus and a gloss control device, and may include various devices relating to an imaging operation.

Figure 1:
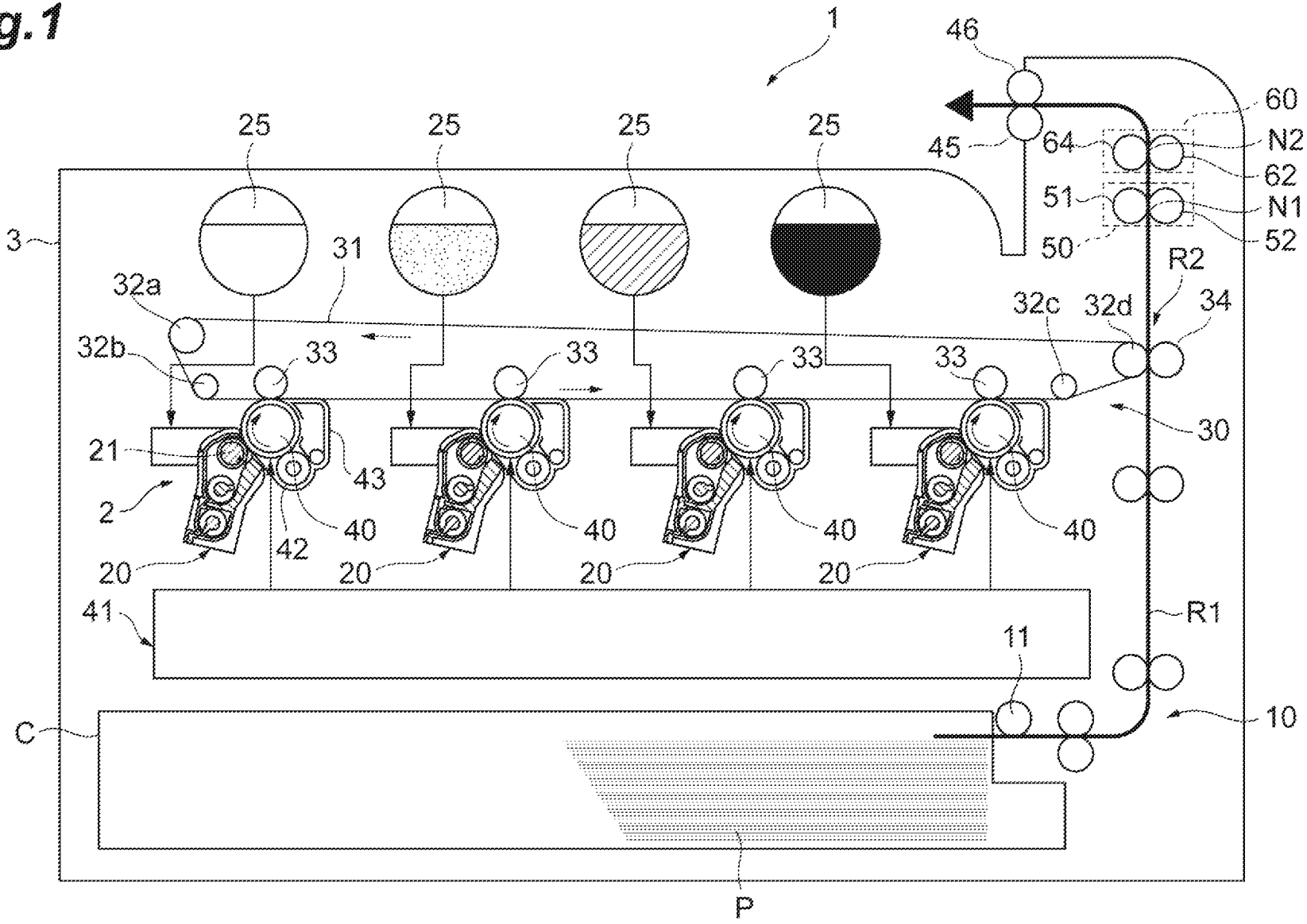
FIG. 1 is a schematic diagram of an example imaging system with an example fixing assembly.

As illustrated in FIG. 1, an example imaging system 1 forms a color image by using respective colors of magenta, yellow, cyan, and black. The example imaging system 1 includes a recording medium conveying device 10, a plurality of developing devices 20, a transfer device 30, a plurality of photoreceptors 40, a fixing device 50, and a fixing assembly 60. The recording medium conveying device 10 may convey a printing medium P. As an example, the printing medium P may be paper.

The photoreceptor 40 may form an electrostatic latent image, and the developing device 20 may develop the electrostatic latent image. The transfer device 30 may secondarily transfer a toner image onto the printing medium P. In some examples, the fixing device 50 fixes the toner image to the printing medium P, and the fixing assembly 60 includes a gloss control device which controls the gloss of the toner image. In some examples, the fixing device 50 may be a primary fixing device which performs a first fixing operation on the printing medium P, and the fixing assembly 60 may be a secondary fixing device which performs a second fixing operation on the printing medium P.

The example recording medium conveying device 10 includes a feeding roller 11 which may convey the printing medium P having an image formed thereon along a conveying path R1. The printing medium P is stacked and stored on a cassette C and is picked up and conveyed by the feeding roller 11. The example feeding roller 11 is provided in the vicinity of an outlet (e.g. the exit) of the cassette C, for the printing medium P. The recording medium conveying device 10 may convey the printing medium P to a secondary transfer region R2 through the conveying path R1 at a timing at which the toner image transferred to the printing medium P reaches the secondary transfer region R2.

In the example imaging system 1, one developing device 20 is provided for each color. Each developing device 20 includes a developing roller 21 which carries toner on the photoreceptor 40. In the example developing device 20 toner and carrier may be adjusted to a predetermined mixing ratio and the toner and the carrier may be mixed and stirred so as to uniformly disperse the toner. The developer may be carried on the developing roller 21. The developing roller 21 may rotate so that the developer is conveyed to a region facing the photoreceptor 40. The toner in the developer carried on the developing roller 21 may be transferred to the electrostatic latent image of the photoreceptor 40 to develop the electrostatic latent image.

The transfer device 30 may convey the toner image formed by the developing device 20 and the photoreceptor 40 to the secondary transfer region R2. In some examples, an image developed by the photoreceptor 40 is transferred to the transfer device 30. The example transfer device 30 includes a transfer belt 31, tension rollers 32*a*, 32*b*, 32*c*, and 32*d*, a primary transfer roller 33, and a secondary transfer roller 34. The example transfer belt 31 is tensioned by the tension rollers 32*a*, 32*b*, 32*c*, and 32*d*. In the example imaging system 1, one primary transfer roller 33 is provided for each color. Each primary transfer roller 33 sandwiches the transfer belt 31 along with each photoreceptor 40. The secondary transfer roller 34 sandwiches the transfer belt 31 along with the tension roller 32*d*.

The example transfer belt 31 is an endless belt which may be moved in a circulating manner by the tension rollers 32*a*, 32*b*, 32*c*, and 32*d*. The primary transfer roller 33 may press against the photoreceptor 40 from the inner peripheral side of the transfer belt 31. The secondary transfer roller 34 presses against the tension roller 32*d* from the outer peripheral side of the transfer belt 31. In some examples, the photoreceptor 40 is a photosensitive drum. In the example imaging system 1, one photoreceptor 40 is provided for each color. The plurality of photoreceptors 40 are arranged side by side along the movement direction of the transfer belt 31. One developing device 20, one exposure unit 41, one charging device 42, and one cleaning device 43 are provided for each photoreceptor 40, at a position facing the outer peripheral surface of the associated photoreceptor 40.

The example imaging system 1 includes a process cartridge 2 which may include the developing device 20, the photoreceptor 40, the charging device 42, and the cleaning device 43, and the example imaging system 1 may further include an apparatus body 3 to and from which the process cartridge 2 is attached and detached (e.g., separated). The process cartridge 2 may be attachable to and detachable (e.g., separable) from the apparatus body 3 through a door of the apparatus body 3 that may be opened to insert or withdraw the process cartridge 2 into and from the apparatus body 3.

In some examples, the charging device 42 uniformly charges the outer peripheral surface of the photoreceptor 40 to a predetermined potential. The charging device 42 is, for example, a charging roller which may rotate to follow the rotation of the photoreceptor 40. The exposure unit 41 may expose the outer peripheral surface of the photoreceptor 40 charged by the charging device 42 in response to the image formed on the printing medium P. A potential of a portion exposed by the exposure unit 41 in the outer peripheral surface of the photoreceptor 40 may change, so that an electrostatic latent image is formed on the outer peripheral surface of the photoreceptor 40.

In the example imaging system 1, one toner tank 25 is disposed to face each of the plurality of developing devices 20. For example, toners of magenta, yellow, cyan, and black are stored in the respective toner tanks 25. The toner may be supplied from each toner tank 25 to the associated developing device 20. Each developing device 20 may develop the electrostatic latent image by the supplied toner and form a toner image on the outer peripheral surface of the photoreceptor 40. The toner image formed on the outer peripheral surface of the photoreceptor 40 may be primarily transferred to the transfer belt 31 and the toner remaining on the outer peripheral surface of the photoreceptor 40 after the primary transferring operation may be removed by the cleaning device 43.

In some examples, the fixing device 50 fixes the toner image which is secondarily transferred from the transfer belt 31 onto the printing medium P to the printing medium P. The example fixing device 50 includes a heating roller 51 to heat the printing medium P and fix the toner image to the printing medium P, and a pressing roller 52 to press against the heating roller 51. The heating roller 51 and the pressing roller 52 may each have a cylindrical shape.

In some examples, a heat source such as a halogen lamp may be provided inside the heating roller 51. Furthermore, a heat source such as a halogen lamp may be provided inside the pressing roller 52. A nip portion N1 which is a fixing region of the printing medium P may be provided between the heating roller 51 and the pressing roller 52. When the printing medium P passes through the nip portion N1, the toner image may be melted and fixed to the printing medium P.

In some examples, the fixing assembly 60 smoothes the toner on the printing medium P to which the toner image is melted and fixed by the fixing device 50 so that the image of the printing medium P becomes glossy. The fixing assembly 60 may increase the glossiness of the image by melting and pressing minute (or fine) unevenness of the toner formed on the printing medium P so as to smooth the toner. The fixing assembly 60 is further described further below. The example imaging system 1 may include discharging rollers 45 and 46 which discharge the printing medium P of which the gloss of the image has been controlled by the fixing assembly 60, to the outside of the imaging system 1.

An example image forming method carried out by the example imaging system 1 will be described. In some examples, when an image signal of a target recording image is input to the imaging system 1, the feeding roller 11 rotates so that the printing medium P stacked on the cassette C is picked up and the printing medium P is conveyed along the conveying path R1. The charging device 42 uniformly charges the outer peripheral surface of the photoreceptor 40 to a predetermined potential on the basis of the image signal. The exposure unit 41 irradiates the outer peripheral surface of the photoreceptor 40 with a laser beam so that an electrostatic latent image is formed on the outer peripheral surface of the photoreceptor 40.

In some examples, the developing device 20 performs a developing operation by forming a toner image on the photoreceptor 40. For example, the toner image is primarily transferred from each photoreceptor 40 to the transfer belt 31 in a region in which each photoreceptor 40 faces the transfer belt 31. For example, the toner images respectively formed on the plurality of photoreceptors 40 may be sequentially layered (or superimposed) on the transfer belt 31 so that a single composite toner image is formed. The composite toner image is secondarily transferred to the printing medium P conveyed from the recording medium conveying device 10 in the secondary transfer region R2 in which the tension roller 32*d* faces the secondary transfer roller 34.

The printing medium P to which the composite toner image is secondarily transferred is conveyed from the secondary transfer region R2 to the fixing device 50. In some examples, the fixing device 50 may melt and fix the composite toner image to the printing medium P by conveying the printing medium P to pass through the nip portion N1 while applying heat and pressure to the printing medium P. For example, the printing medium P to which the composite toner image is melted and fixed may be conveyed to the fixing assembly 60. The fixing assembly 60 smoothes the toner by melting and pressing the toner of the composite toner image again (e.g., re-melting).

The fixing assembly 60 may harden the toner by cooling the printing medium P having a smoothened composite toner image. Accordingly, the fixing assembly 60 may increase the glossiness of the image of the printing medium P so that the image of the printing medium P has a surface similar to a photo image, to obtain a high-quality image. The printing medium P of which the image quality is increased by the fixing assembly 60 may be discharged to the outside of the imaging system 1 by the discharging rollers 45 and 46.

Figure 2:
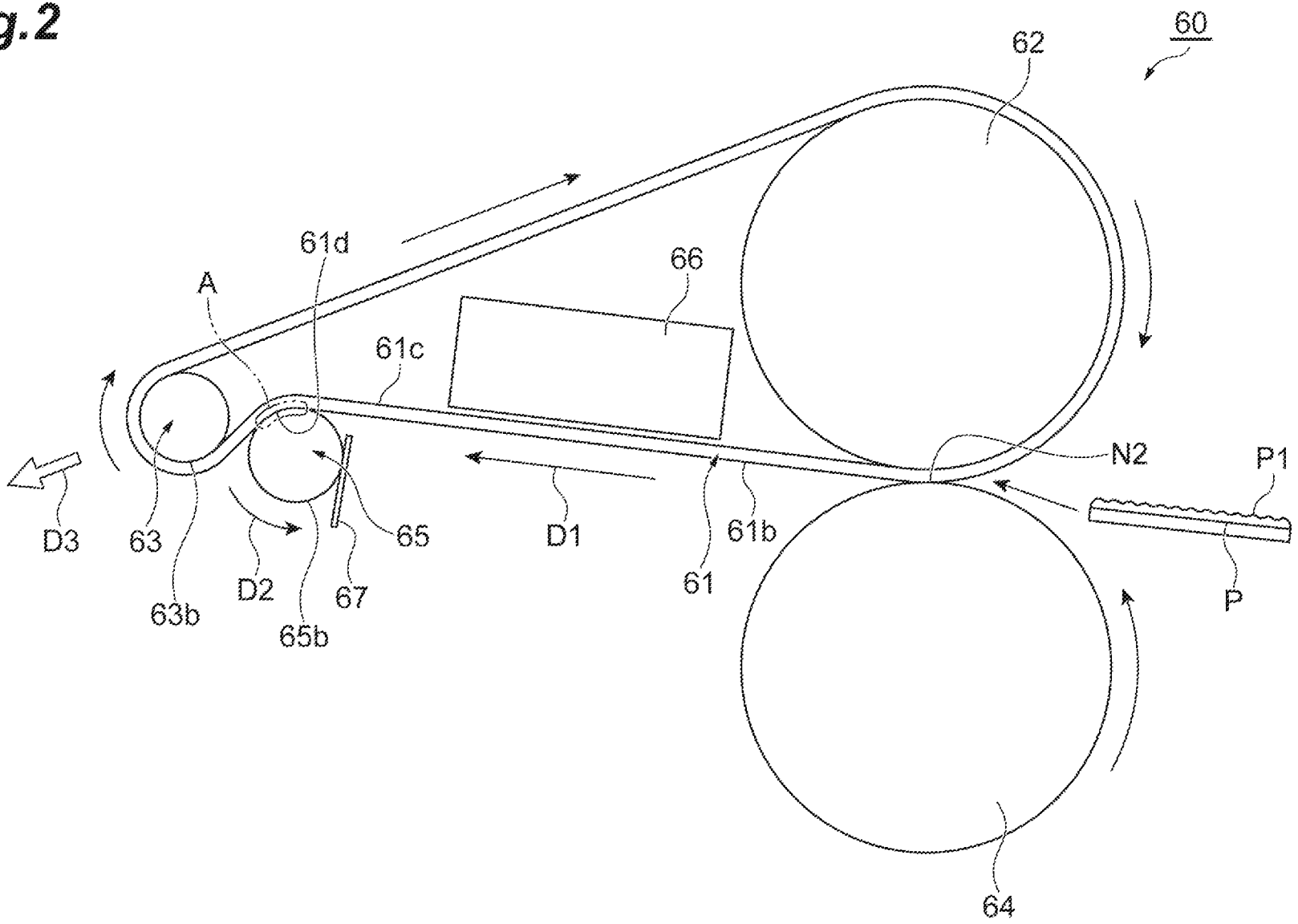
FIG. 2 is a schematic diagram of the example fixing assembly of the example imaging system illustrated in FIG. 1.

With reference to FIG. 2, the example fixing assembly 60 includes an endless belt 61 which conveys the printing medium P, heating member 62 and tensioning member 63 which are rotation bodies for tensioning the endless belt 61, a pressing member 64 which is a rotation body for pressing the printing medium P, a cleaning member 65 that cleans the endless belt 61, and a cooling member 66 that cools the endless belt 61. As an example, the heating member 62 may be a roll-shaped heating roller, or the heating member 62 may be a belt-shaped heating belt.

In some examples, the printing medium P which passes through the outer surface of the heating member 62 is loaded on the endless belt 61. As an example, the endless belt 61 includes an outer surface 61*b* on which the printing medium P is loaded and an inner surface 61*c* which contacts the outer peripheral surface of the heating member 62 and the outer peripheral surface of the tensioning member 63. In some examples, the heating member 62, the tensioning member 63, and the cooling member 66 are located inside the endless belt 61, and the pressing member 64 and the cleaning member 65 are located outside the endless belt 61.

The heating member 62 may heat the endless belt 61 and generate a high-temperature region inside the imaging system 1. The cooling member 66 may cool the endless belt 61 and generates a low-temperature region inside the imaging system 1. As an example, the high-temperature region may be a region including the heating member 62 and may include a portion of the endless belt 61 heated by the heating member 62. Meanwhile, the low-temperature region may be a region including the cooling member 66 and may include, for example, a portion of the endless belt 61 cooled by the tensioning member 63, the cleaning member 65, and the cooling member 66.

In some examples, the heating member 62 may include a free belt which is operated by receiving power from the outside of the fixing assembly 60. In some examples, a nip portion N2 which is a fixing region of the printing medium P, is formed between the heating member 62 and the pressing member 64. A contact pressure is generated between the heating member 62 and the pressing member 64 so that the nip portion N2 is formed by this contact pressure. As an example, the nip portion N2 is a re-melting portion which re-melts a toner image P1 of the printing medium P. In this case, the printing medium P may pass through the nip portion N2 so that the toner image P1 of the printing medium P becomes smooth.

The tensioning member 63 is, for example, a rotatable tension roller. The tensioning member 63 may be, for example, a support roller which supports the endless belt 61 from the inside of the endless belt 61, where the endless belt 61 moves in a circumferential direction along the outer peripheries of the heating member 62 and the tensioning member 63. As an example, the printing medium P is conveyed along the endless belt 61 through the nip portion N2 and the low-temperature region of the cooling member 66, toward the outside of the fixing assembly 60.

The pressing member 64 may be for example, a pressing roller which is formed in a roller shape. In some examples the pressing member may have a shape other than a roller shape. As an example, the surface hardness of the pressing member 64 may be equal to or greater than 45, and equal to or less than 80 in terms of the hardness of ASKER-C. The heating member 62 may be, for example, a rigid body and the surface hardness of the heating member 62 may be equal to or less than the surface hardness of the pressing member 64.

The cooling member 66 may include, for example, at least one of a heat sink which contacts the inner surface 61*c* of the endless belt 61 or a fan which blows air to the endless belt 61. The cooling member 66 may include, for example, at least one of a peltier device or a heat pipe. The cooling member 66 may cool and harden the toner image P1 of the printing medium P smoothed while passing through the nip portion N2.

The cleaning member 65 is, for example, a cleaning roller which presses the outer surface 61*b* of the endless belt 61 toward the inside of the endless belt 61. In some examples, the cleaning member 65 is a rotatable cleaning roller. The example cleaning member 65 is disposed between the heating member 62 and the tensioning member 63 so that the endless belt 61 moving from the nip portion N2 toward the tensioning member 63 through the cooling member 66 is pressed inwardly. In some examples, the cleaning member 65 is disposed on the upstream side of the tensioning member 63 in the movement path of the endless belt 61.

In some examples, the cleaning member 65 is provided at a position in which the outer surface 61*b* of the endless belt 61 is urged toward the inside of the endless belt 61 and a concave portion 61*d* in a portion of the endless belt 61 that is adjacent the cleaning member 65. As an example, components do not exist inside the endless belt 61 in alignment with the cleaning member 65 (e.g., at the side opposite of the endless belt, relative to the cleaning member 65). Accordingly, the concave portion 61*d* is formed in a portion pressed by the cleaning member 65 in the endless belt 61 and stress to the endless belt 61 by the cleaning member 65 is suppressed.

The example cleaning member 65 includes a drive roller which rotates in a direction D2 following a movement direction D1 of the endless belt 61. The cleaning member 65 may rotate by receiving a driving force from a drive source such as a motor. In some examples, the cleaning member 65 frictionally contacts the outer surface 61*b* of the endless belt. For example, the cleaning member 65 may be movable with respect to the endless belt 61 and may contact the outer surface 61*b* of the endless belt 61 with a friction force. In some examples, the endless belt 61 includes a contact region A which comes into surface-contact with a surface 65*b* of the cleaning member 65 and the contact region A extends in the direction D2.

In some examples, the rotation speed of the cleaning member 65 in the direction D2 may be different from the movement speed of the endless belt 61 in the direction D1. In some examples, the adhesion (or adhesion characteristic) of the surface 65*b* of the cleaning member 65 is greater than the adhesion (or adhesion characteristic) of the outer surface 61*b* of the endless belt 61. Accordingly, foreign matter such as toner adhering to the outer surface 61*b* of the endless belt 61 can be more efficiently scraped off, for example by adhering more easily to the cleaning member 65 than to the endless belt 61. In some examples, the rotation speed of the cleaning member 65 is slower than the movement speed of the endless belt 61. For example, the rotation speed of the cleaning member 65 may be adjustable by controlling the drive source of the cleaning member 65.

The fixing assembly 60 may include a blade 67 which contacts the surface 65*b* of the cleaning member 65. The blade 67 may scrape off foreign matter adhering to the surface 65*b* by contacting the surface 65*b* of the rotating cleaning member 65. In some examples, the cleaning member 65 is disposed at the lower side of the endless belt 61 in the direction of gravity, to cause the foreign matter scraped off by the cleaning member 65 and the blade 67, to fall down in the direction of gravity.

For example, the cleaning member 65 is provided at a position adjacent to the tensioning member 63 and separated from the tensioning member 63. As an example, the endless belt 61 passes through the upper side of the cleaning member 65 in the direction of gravity and is curved downward in the direction of gravity as it goes from the cleaning member 65 toward the tensioning member 63.

In some examples, the endless belt 61 which extends downward in the direction of gravity as it goes from the cleaning member 65 toward the tensioning member 63 is curved along the outer peripheral surface 63*b* of the tensioning member 63 and extends from the tensioning member 63 toward the heating member 62. The fixing assembly 60 may include a spring which urges the tensioning member 63 in a direction D3 opposite to the heating member 62, to increase the tension of the endless belt 61 passing through the tensioning member 63, the heating member 62, and the cleaning member 65.

Figure 3:
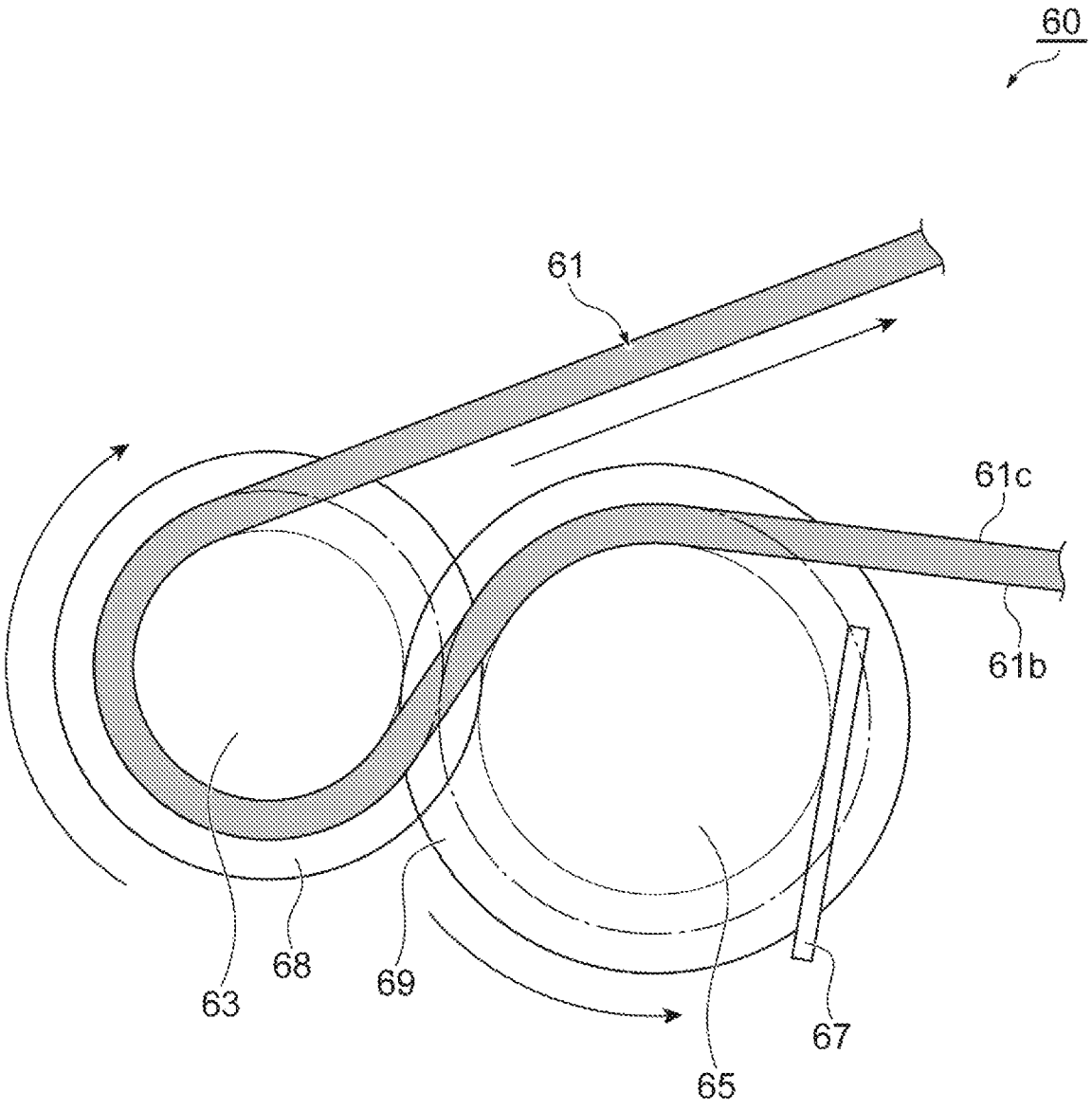
FIG. 3 is a schematic diagram of a tensioning member and a cleaning roller of an example fixing assembly, illustrated with a first gear connected to the tensioning member and a second gear connected to the cleaning roller.

FIG. 3 is a diagram illustrating an example in which the tensioning member 63 and the cleaning member 65 are enlarged. With reference to FIG. 3, the fixing assembly 60 may include a first gear 68 which is connected to the tensioning member 63 and a second gear 69 which is connected to the cleaning member 65 and engages with the first gear 68. The tensioning member 63 is connected to the cleaning member 65 through the first gear 68 and the second gear 69. As an example, the driving force of the tensioning member 63 is transmitted to the cleaning member 65 through the first gear 68 and the second gear 69.

In some examples, the diameter of the second gear 69 connected to the cleaning member 65 is larger than the diameter of the first gear 68 connected to the tensioning member 63, and the number of teeth of the second gear 69 is greater than the number of teeth of the first gear 68. In this case, the rotation speed of the cleaning member 65 is slower than the rotation speed of the tensioning member 63 and the movement speed of the endless belt 61. A difference in speed of the rotation speed of the cleaning member 65 with respect to the movement speed of the endless belt 61, allows the cleaning member 65 to clean the outer surface 61*b* of the endless belt 61.

Figure 4:
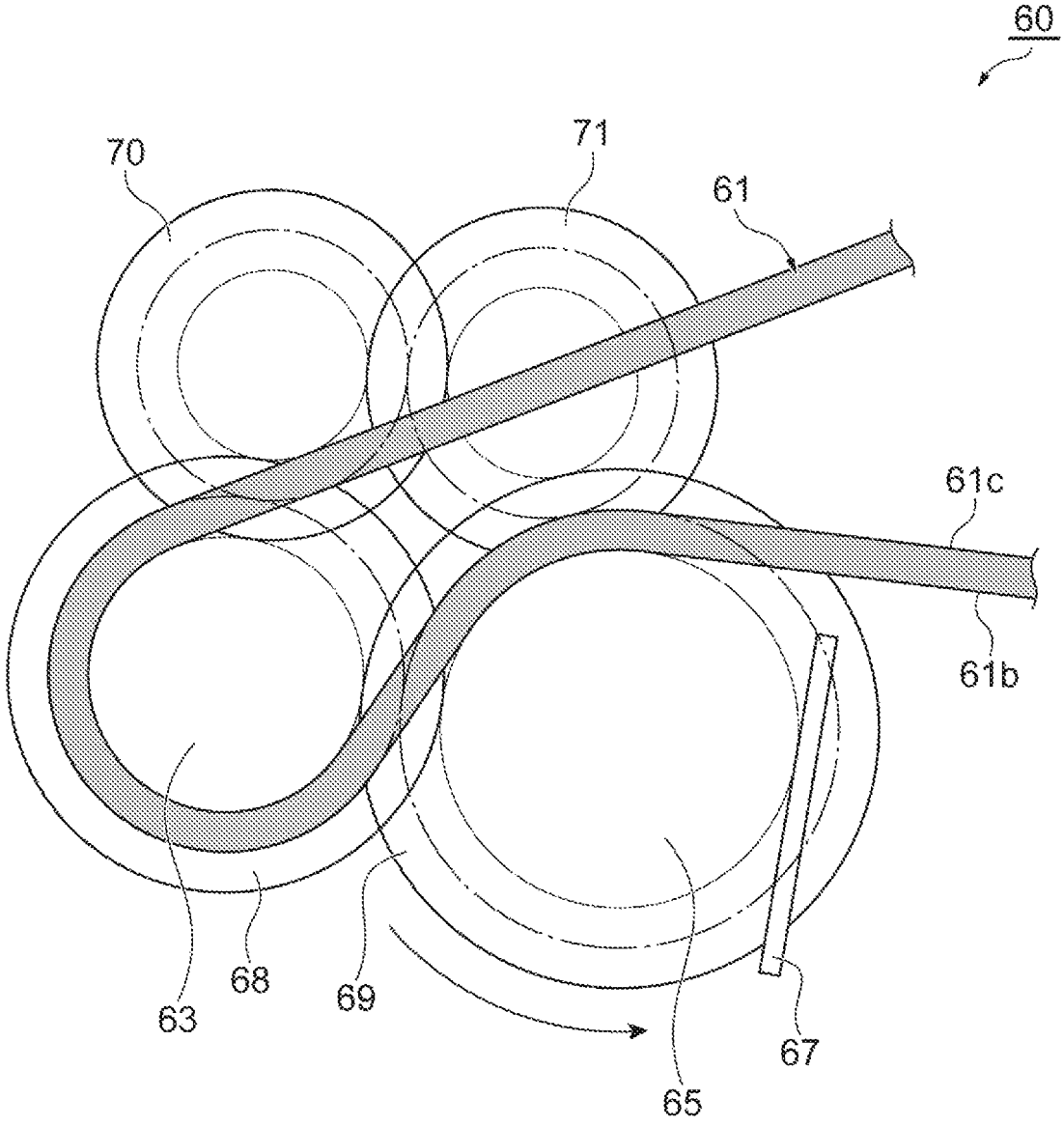
FIG. 4 is a schematic diagram illustrating an example of a gear group further including third and fourth gears.

FIG. 4 illustrates an example in which a third gear 70 and a fourth gear 71 are further provided in addition to the first gear 68 and the second gear 69. In this example, the third gear 70 is connected to the first gear 68, the fourth gear 71 is connected to the second gear 69, and the cleaning member 65 is connected to the tensioning member 63 through the second gear 69, the fourth gear 71, the third gear 70, and the first gear 68, in order to suitably change the number of gears connecting the tensioning member 63 and the cleaning member 65.

Figure 5:
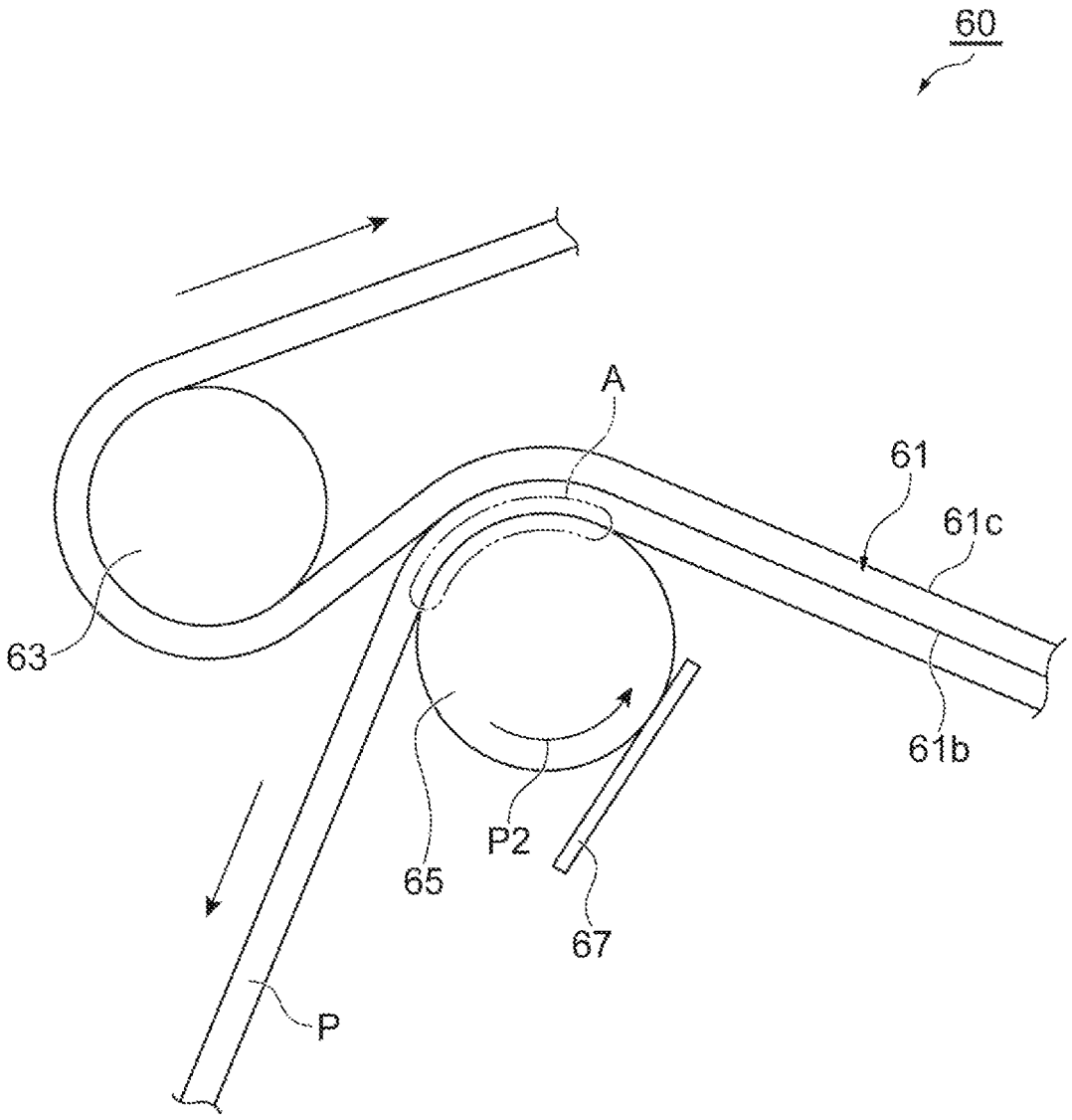
FIG. 5 is an enlarged partial view of example fixing assembly of FIG. 2, illustrating the cleaning roller and the tensioning member of the example fixing assembly.
Figure 6:
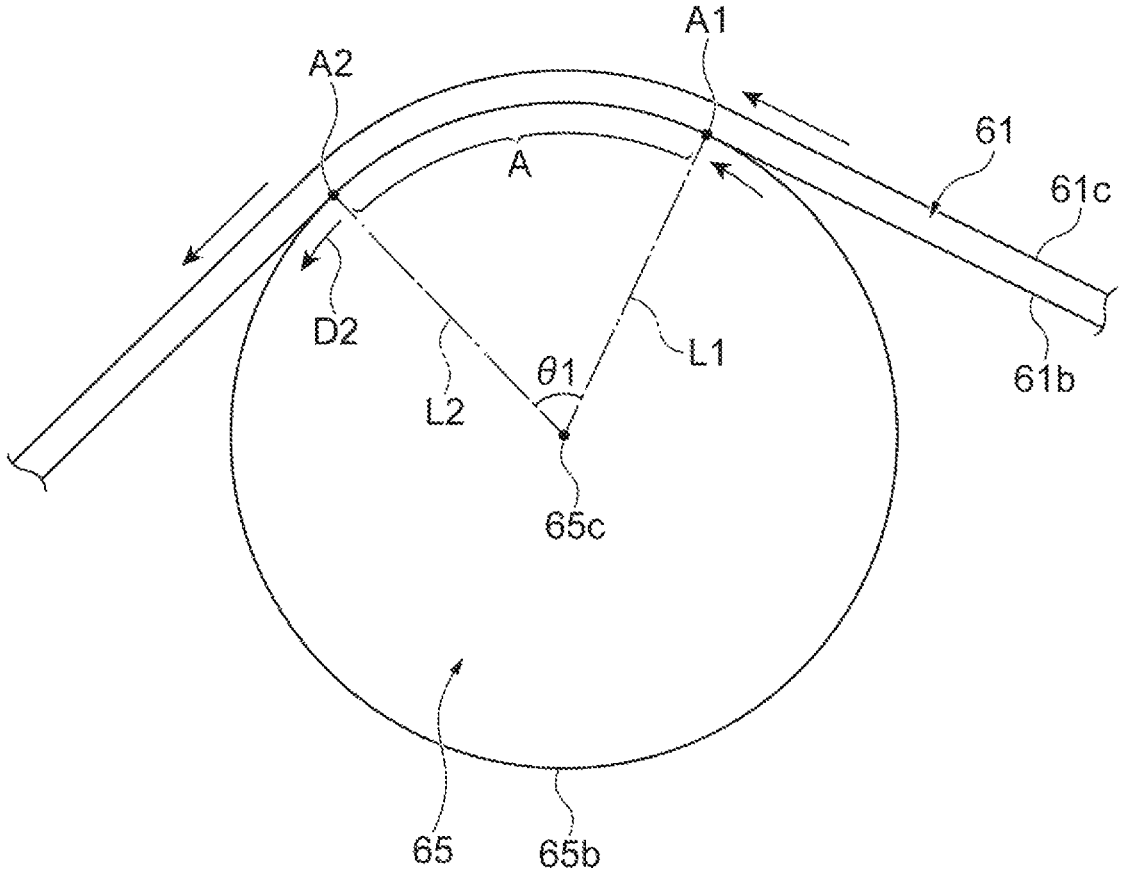
FIG. 6 is an enlarged view of the cleaning roller and the endless belt of FIG. 5.

FIG. 5 is a diagram illustrating an example of the printing medium P passing through the endless belt 61 and the cleaning member 65. FIG. 6 is an enlarged view of the endless belt 61 passing through the surface 65*b* of the cleaning member 65. The printing medium P is conveyed along the endless belt 61, is separated from the cleaning member 65, and is further conveyed to the outside of the fixing assembly 60. The contact region A of the endless belt 61 with respect to the cleaning member 65 extends from one end (e.g., a first end) A1 to the other end (e.g., a second end) A2 in the direction D2 and the endless belt 61 comes into surface-contact with the cleaning member 65 between the first end A1 and the second end A2. The second end A2 provides an exit of the contact region where the endless belt 61 is separated from the cleaning member 65.

A first line L1 connecting the first end A1 of the contact region A in the direction D2 and a center 65*c* of the cleaning member 65 forms an angle θ1 with a second line L2 connecting the second end A2 of the contact region A in the direction D2 and the center 65*c* of the cleaning member 65. The angle θ1 may be, for example, greater than 0° and equal to or less than 90°. The cleaning member 65 may be disposed so that the angle θ1 corresponding to a wound angle of the endless belt 61 with respect to the cleaning member 65 is greater than 0° and equal to or less than 90°. The angle θ1 may be associated with an arc portion of the endless belt 61 that is wound about the cleaning member 65 (e.g., the arc portion of the endless belt 61 that is in contact with the cleaning member 65).

Figure 7A:
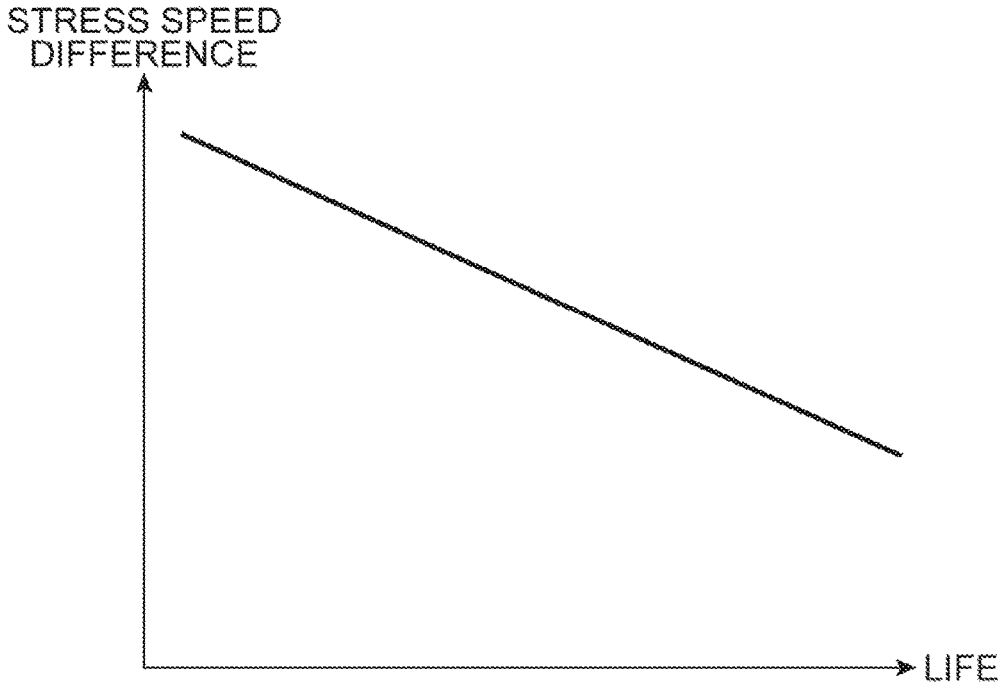
FIG. 7A is a graph showing an example relationship of a difference of stress and speed associated with the endless belt, relative to a lifespan of the endless belt.
Figure 7B:
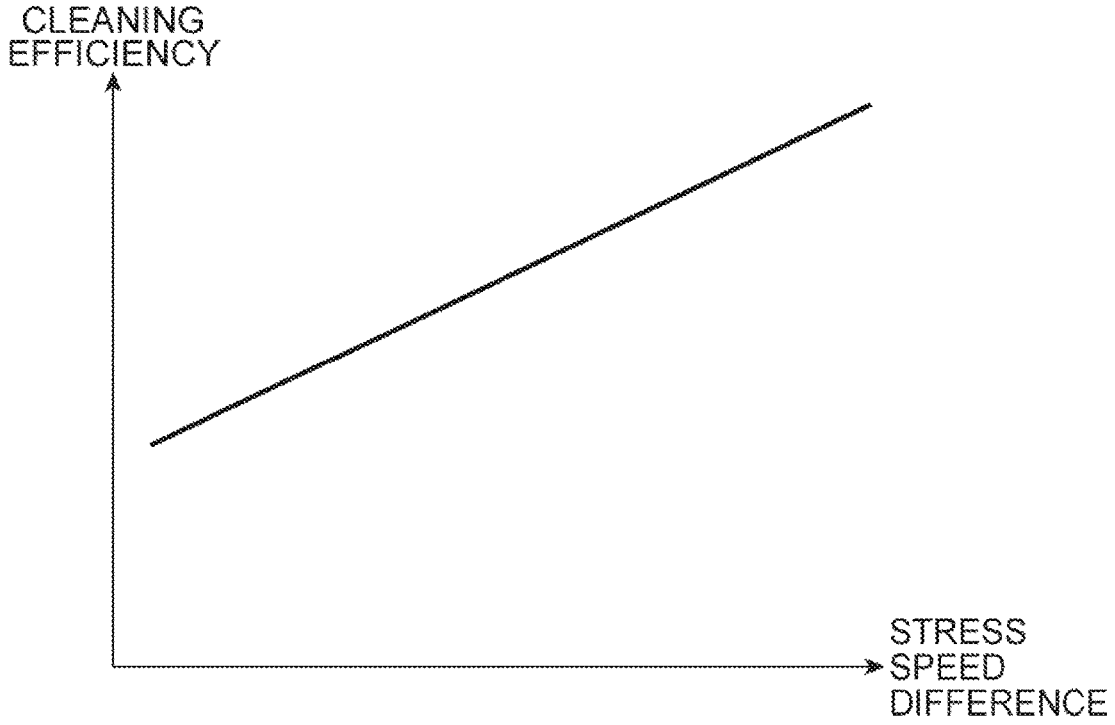
FIG. 7B is a graph showing an example relationship of a cleaning efficiency, relative to a difference between stress and speed difference to the endless belt.

An operation of the example imaging system 1 with the above-described configuration will be described. FIG. 7A shows a graph of a relationship between the stress and speed difference of the cleaning member 65 with respect to the endless belt 61 and the life (or lifespan) of the endless belt 61. FIG. 7B shows a graph of a relationship between the cleaning efficiency of the endless belt 61 by the cleaning member 65 and the stress and speed difference of the cleaning member 65 with respect to the endless belt 61.

With reference to FIGS. 7A and 7B, as the stress or speed difference with respect to the endless belt 61 increase, the life of the endless belt 61 is shortened, but the cleaning efficiency for the endless belt 61 is improved. The wear of the endless belt 61 can be prevented when the stress and speed difference with respect to the endless belt 61 decreases, thus extending the life of the endless belt 61. When the stress and speed difference with respect to the endless belt 61, decrease, the cleaning efficiency of the cleaning member 65 may be deteriorated.

Figure 8:
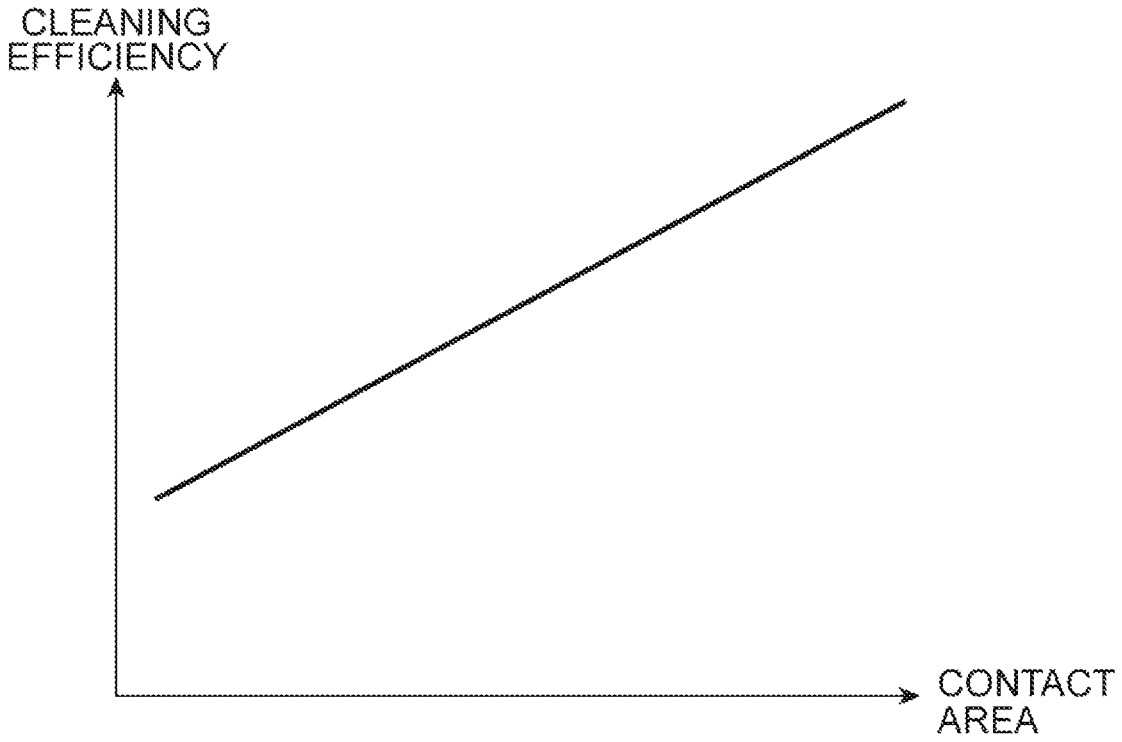
FIG. 8 is a graph showing an example relationship of a printing medium cleaning efficiency relative to a contact area of a cleaning roller with respect to the endless belt.

Therefore, in the above-described example, since the cleaning member 65 presses the endless belt 61 inward, the area of the contact region A of the cleaning member 65 with respect to the endless belt 61 is widened (or increased). In this case, with reference to the graph of FIG. 8, the cleaning efficiency of the endless belt 61 by the cleaning member 65 can be improved while extending the life of the endless belt 61 by suppressing the stress of the cleaning member 65 with respect to the endless belt 61 and by widening the contact region A.

The cleaning member 65 may be a rotatable cleaning roller. The endless belt 61 may include the contact region A which comes into surface-contact with the surface 65*b* of the cleaning member 65, and the contact region A may extend along the direction D2 corresponding to the rotation direction (or rotational direction) of the cleaning member 65. Accordingly, the contact region A is widened (or increased) while suppressing the stress of the cleaning member 65 with respect to the endless belt 61 to extend the life of the endless belt 61 and to improve the cleaning efficiency.

As described above, the angle θ1 corresponding to the angle formed by the line L1 connecting the first end A1 of the contact region A in the direction D2 and the center 65*c* of the cleaning member 65 and the line L2 connecting the second end A2 of the contact region A in the direction D2 and the center 65*c* of the cleaning member 65, may be greater than 0° and equal to or less than 90°. Accordingly, the endless belt 61 may be pressed by the cleaning member 65 and the endless belt 61 may be prevented from being excessively deformed. Further, the adhesion of the surface

65*b* of the cleaning member 65 may be greater than the adhesion of the outer surface 61*b* of the endless belt 61. For example, the adhesion of the surface 65*b* of the cleaning member 65 may be set to an adhesion in which foreign matter such as toner or paper dust sandwiched between the surface 65*b* and the outer surface 61*b* of the endless belt 61 adheres to the surface 65*b* when the endless belt 61 is separated from the cleaning member 65. Accordingly, the adhesion of the surface 65*b* of the cleaning member 65 may be an adhesion for allowing foreign matter to adhere to the surface 65*b*, in order to more reliably remove the foreign matter adhering to the endless belt 61 by the cleaning member 65.

The cleaning member 65 may be a drive roller which rotates by receiving a driving force in order to change the rotation speed of the cleaning member 65 by controlling the drive source of the cleaning member 65. The cleaning member 65 rotates in the movement direction of the endless belt 61, and the rotation speed of the cleaning member 65 may be different from the movement speed of the endless belt 61 in order to further improve the cleaning efficiency due to a speed difference of the cleaning member 65 with respect to the endless belt 61.

The cleaning member 65 may be disposed at the lower side of the endless belt 61 in the direction of gravity. Accordingly, foreign matter scraped off from the endless belt 61 by the cleaning member 65 can fall by gravity, and the falling foreign matter can be more easily stored when a foreign matter collection container is disposed below the endless belt 61 in order to simplify a configuration that stores the foreign matter.

As described above, the example imaging system 1 may include the first gear 68 which is connected to the tensioning member 63 and the second gear 69 which is connected to the cleaning member 65 and engages with the first gear 68. The tensioning member 63 may be a rotatable tension roller and the number of teeth of the second gear 69 may be different from the number of teeth of the first gear 68. In this case, the cleaning member 65 can be connected to the tensioning member 63 by the first gear 68 and the second gear 69 and a rotational driving force can be transmitted from the tensioning member 63 to the cleaning member 65.

Accordingly, the tensioning member 63 and the cleaning member 65 can be operated in an interlocked manner. The number of teeth of the second gear 69 may be different from the number of teeth of the first gear 68. Accordingly, the rotation speed of the cleaning member 65 is different from the rotation speed of the tensioning member 63 and the movement speed of the endless belt 61, thus resulting in a speed difference between the cleaning member 65 and the tensioning member 63 or the endless belt 61, in order to improve the cleaning efficiency by using the driving force from the tensioning member 63.

Figure 9A:
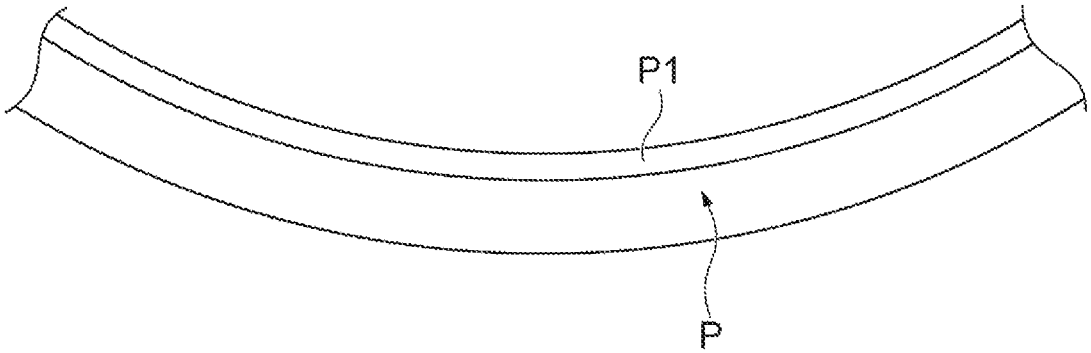
FIG. 9A is a schematic diagram illustrating an example of a toner image on the endless belt.
Figure 9B:
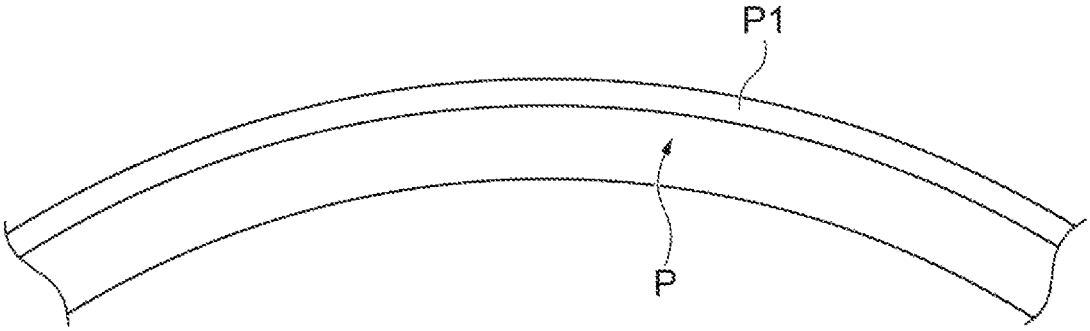
FIG. 9B is a schematic diagram illustrating another example of a toner image on the endless belt.

With reference to FIGS. 9A and 9B, in a phenomenon called curl, the printing medium P having the toner image P1 formed thereon may be curved or curled. The curl may be caused by, for example, a difference in thermal expansion coefficient between the toner image P1 and the printing medium P or a curvature of the nip portion N2. The printing medium P may be curved in a U-shape and a case in which the printing medium P is curved in an inverse U-shape. The printing medium may tend to curve in a U-shape as the image density of the toner image P1 increases, and the printing medium may tend to curve in an inverse U-shape as the image density of the toner image P1 decreases.

Figure 10:
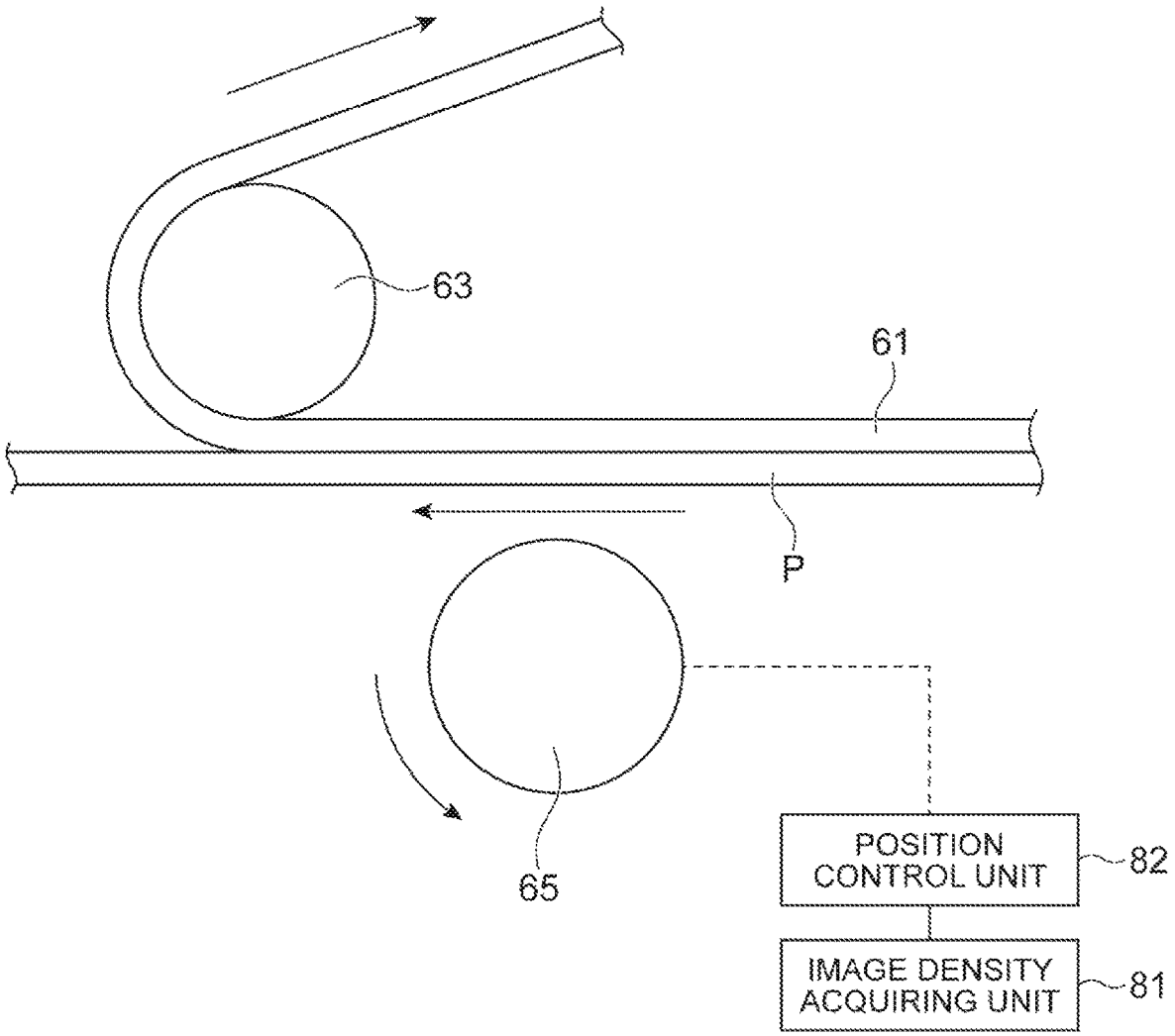
FIG. 10 is a diagram illustrating a cleaning roller, a tensioning member, an endless belt, and a printing medium according to a modified example.
Figure 11:
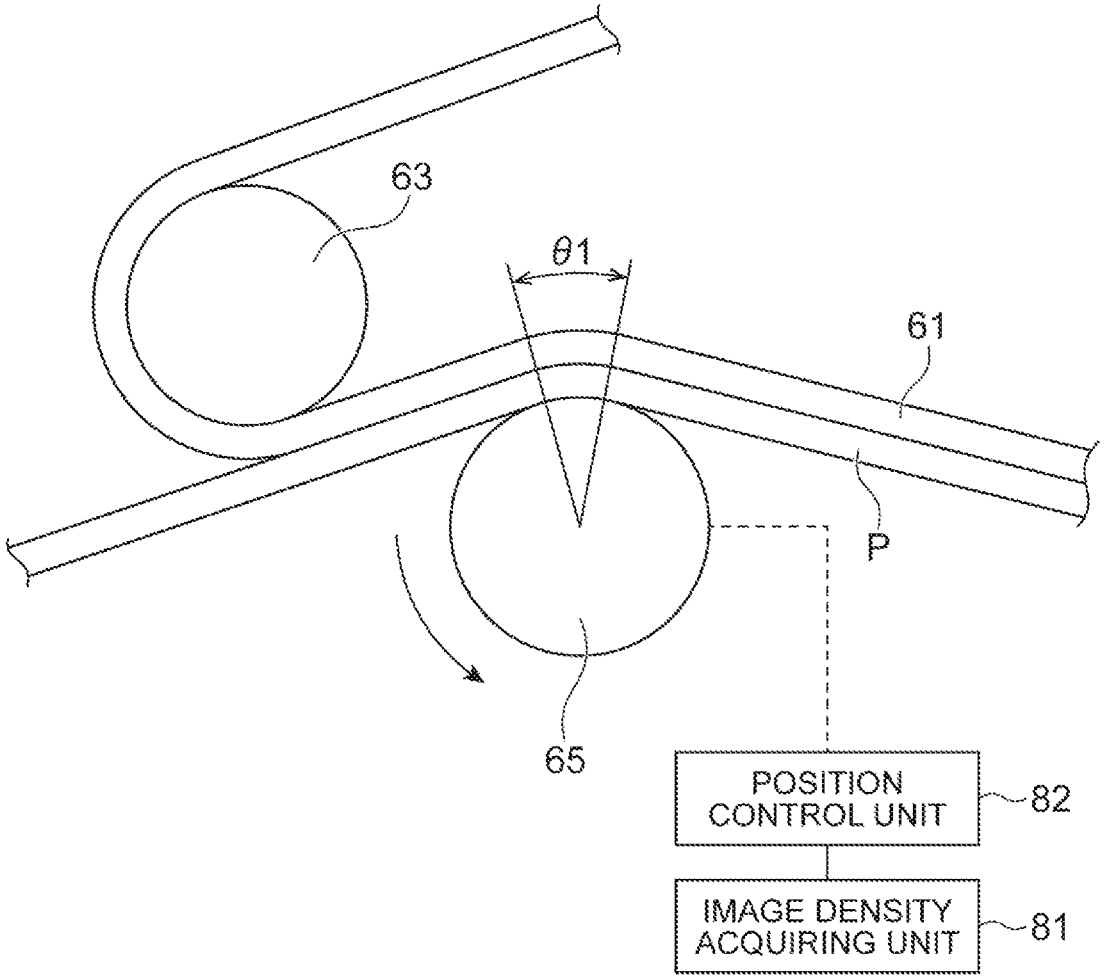
FIG. 11 is a diagram illustrating an example of a state in which a cleaning roller according to another modified example presses the endless belt inwardly.

With reference to FIGS. 10 and 11, the imaging system may include an image density acquiring unit 81 which acquires image density of the image surface of the printing medium P and a position control unit 82 which controls the position of the cleaning member 65 with respect to the endless belt 61. In some examples, according to the position control unit 82, the cleaning member 65 may contact the endless belt 61 when the image density of the printing medium P acquired by the image density acquiring unit 81 is equal to or greater than a predetermined value and the cleaning member 65 may be separated from the endless belt 61 when the image density of the printing medium P is less than the predetermined value. As an example, the position control unit 82 may include a cam mechanism which changes the position of the cleaning member 65 with respect to the endless belt 61.

Since the cleaning member 65 contacts the endless belt 61 during the passage of the printing medium P having high image density and formed in a U-shape, the printing medium P curled in a U-shape is corrected. Since the cleaning member 65 is separated from the endless belt 61 during the passage of the printing medium P having low image density, the printing medium P passes between the cleaning member 65 and the endless belt 61 and is separated from the tensioning member 63. Since the adhesion of the printing medium P with respect to the endless belt 61 is low when the image density of the printing medium P is low, the printing medium P is more easily separated from the tensioning member 63.

As described above, in the examples illustrated in FIGS. 10 and 11, the cleaning member 65 may contact the endless belt 61 and be separated therefrom, to control the position of the cleaning member 65 in response to the curl state occurring in the printing medium P, for example, the image density state of the toner image P1.

In the examples illustrated in FIGS. 10 and 11, the example imaging system 1 includes the image density acquiring unit 81 which acquires the image density of the image surface of the printing medium P having the toner image P1 fixed thereto and the cleaning member 65 may contact the endless belt 61 when the image density acquired by the image density acquiring unit 81 is equal to or greater than a predetermined value and may be separated from the endless belt 61 when the image density acquired by the image density acquiring unit 81 is less than the predetermined value, in order to correct the curl of the printing medium P.

Figure 12:
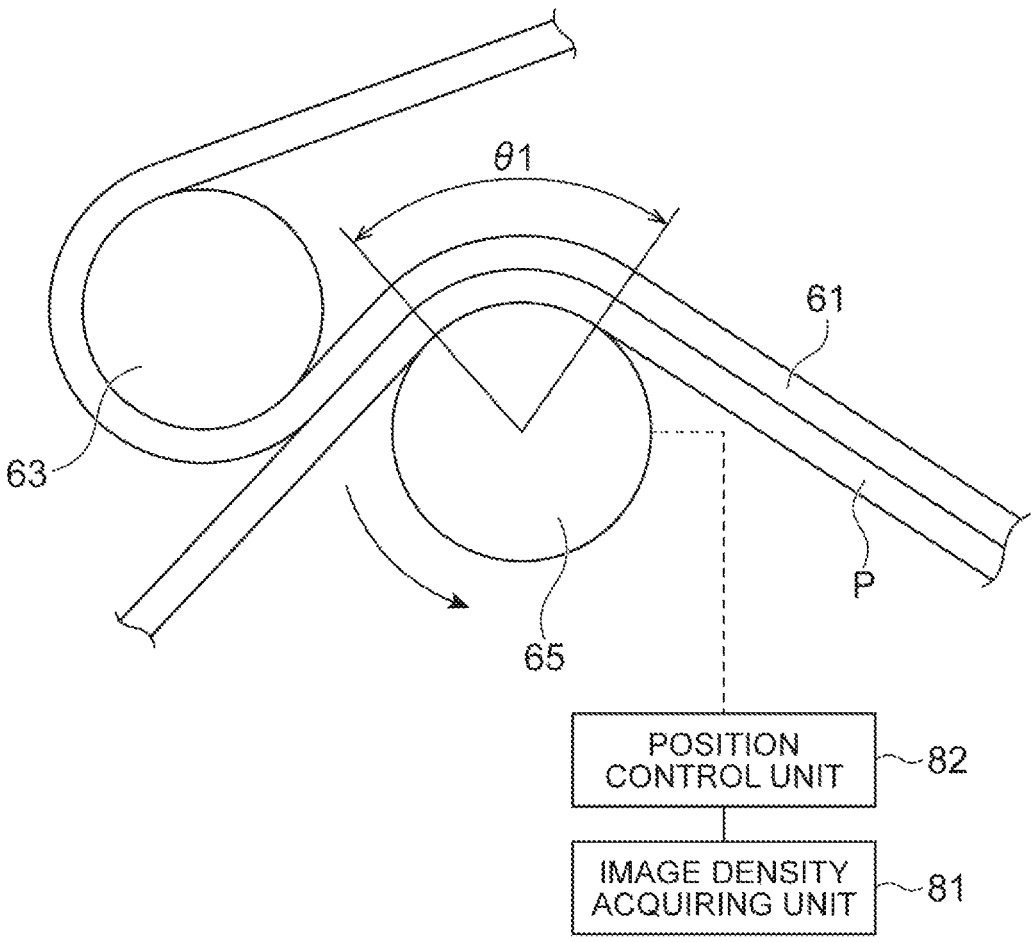
FIG. 12 is a diagram illustrating an example of a state in which the cleaning roller of FIG. 11 presses the endless belt further inwardly.

With reference to FIGS. 11 and 12, the cleaning member 65 may be movable with respect to the endless belt 61 and the above-described angle θ1 may be changeable when the pressing amount (e.g., pressure or biasing force) of the cleaning member 65 with respect to the endless belt 61 is adjusted. Since the pressing amount of the cleaning member 65 with respect to the endless belt 61 can be adjusted in response to the image density acquired by the image density acquiring unit 81, for example, the degree of curl of the printing medium P, may be corrected more accurately.

For example, when the cleaning member 65 is located at the side opposite to the conveying side (the sheet conveying side) of the printing medium P, the cleaning member 65 may be separated from the endless belt 61 when the rotation of the endless belt 61 stops. Further, the cleaning member 65 may contact the endless belt 61 when the printing medium P does not pass through the nip portion N2 and may be separated from the endless belt 61 when the printing medium P passes through the nip portion N2. For example, the cleaning member 65 may contact the endless belt 61 in a non-sheet-passing state and the cleaning member 65 may be separated from the endless belt 61 in a sheet-passing state. The cleaning member 65 is separated from the endless belt 61 in the sheet-passing state to convey the printing medium P more smoothly, and the cleaning member 65 contacts the endless belt 61 in a non-sheet-passing state to perform a cleaning operation more intensively.

Figure 13:
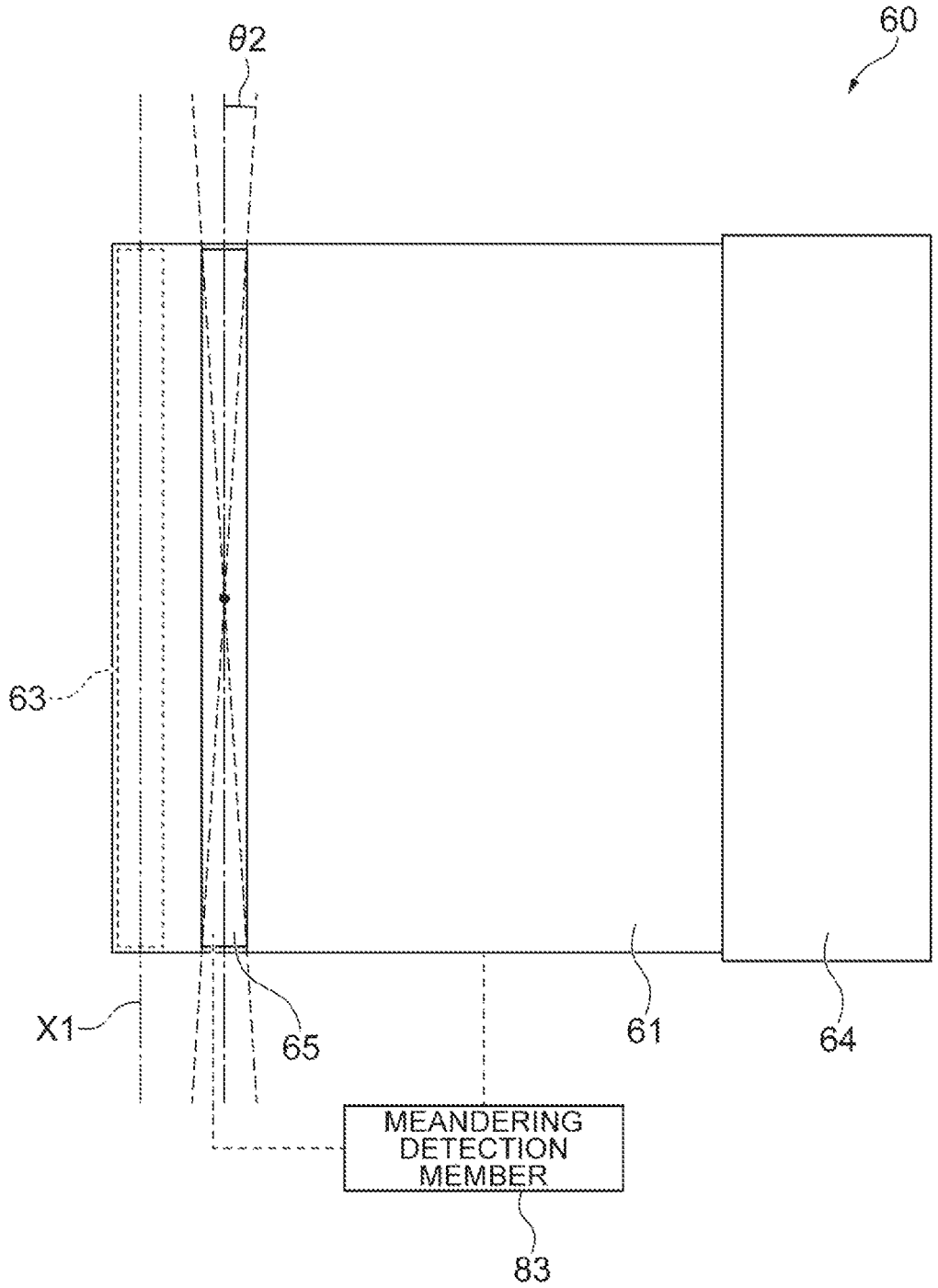
FIG. 13 is a diagram illustrating an example of a fixing assembly including a cleaning roller and an endless belt according to still another modified example.
Figure 14:
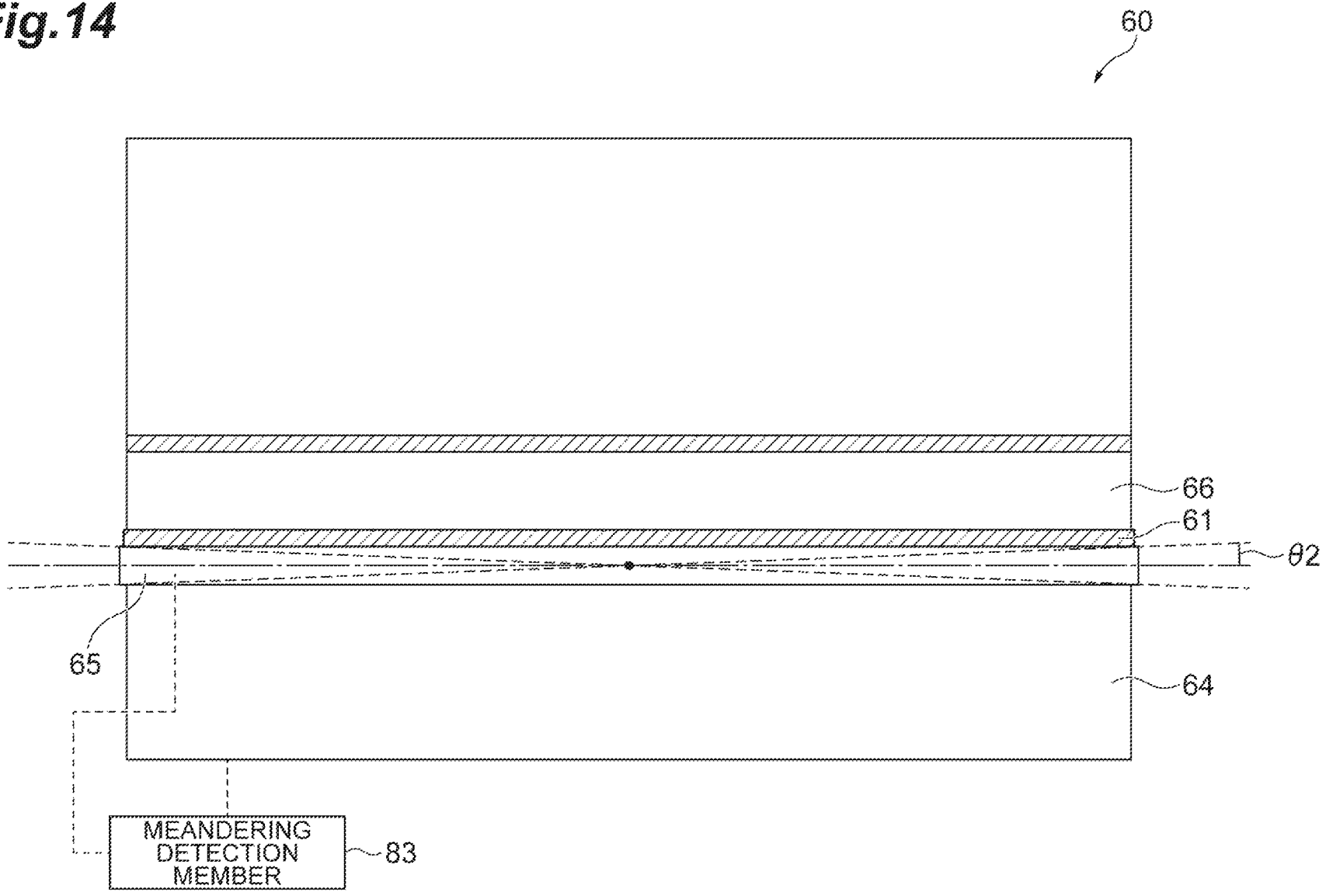
FIG. 14 is a diagram illustrating the fixing assembly including the cleaning roller of FIG. 13 as viewed from a direction different from FIG. 13.

With reference to FIGS. 13 and 14, the cleaning member 65 may be tiltable with respect to the extension direction of the axis X1 of the tensioning member 63. The tensioning member 63 may be a tension roller which is rotatable about the axis X1 and the cleaning member 65 may extend in the extension direction of the axis X1. In some examples, the imaging system 1 may include a meandering detection member 83 that detects the meandering of the endless belt 61. When the meandering detection member 83 detects the deviation (meandering) of the endless belt 61, the cleaning member 65 is tilted, to correct the deviation of the endless belt 61.

As described above, in the examples illustrated in FIGS. 13 and 14, the cleaning member 65 is tiltable with respect to the extension direction of the axis X1. An angle θ2 corresponding to a tilting angle of the cleaning member 65 with respect to the axis X1 may be, for example, ±10°, but is appropriately changeable. Accordingly, the meandering of the endless belt 61 may be prevented when the cleaning member 65 contacting the endless belt 61 is tilted.

Figure 15:
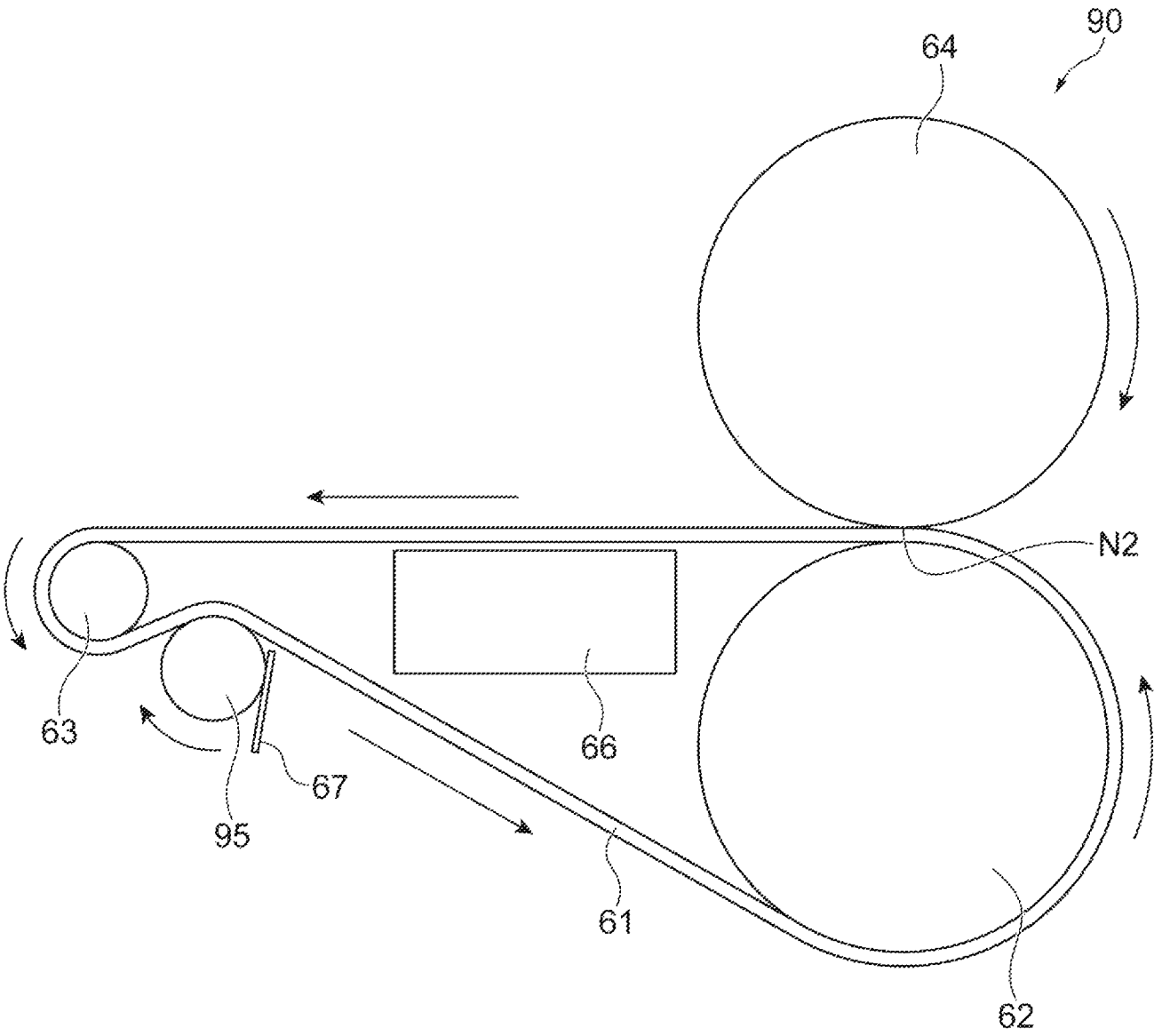
FIG. 15 is a schematic diagram of a fixing assembly according to another modified example.
Figure 16:
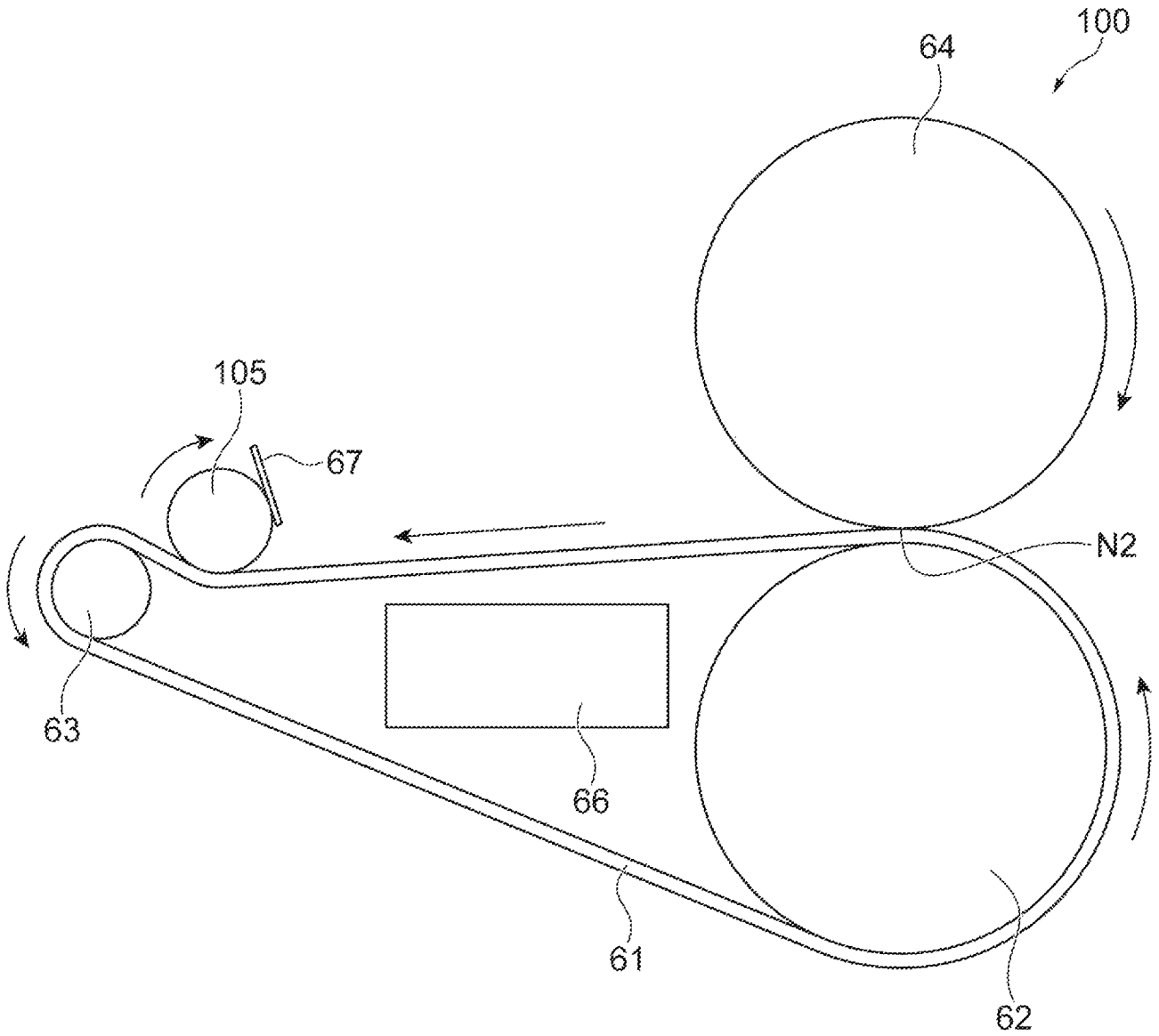
FIG. 16 is a schematic diagram of a fixing assembly according to another modified example.

With reference to FIG. 15, a fixing assembly 90 according to a modified example includes a cleaning member 95 that is disposed on the downstream side of the tensioning member 63 in the movement path of the endless belt 61. With reference to FIG. 16, a fixing assembly 100 according to still another modified example includes a cleaning member 105 that is disposed at the upper side of the endless belt 61 in the direction of gravity. With reference to the example of FIG. 16, in a case in which the cleaning member 105 is located at the conveying side (the sheet conveying side) of the printing medium P, the cleaning member 105 may contact the endless belt 61 when the printing medium P does not pass through the nip portion N2 and may be separated from the endless belt 61 when the printing medium P passes through the nip portion N2 and the rotation of the endless belt 61 stops. As in the above-described examples, the position of the cleaning member with respect to the endless belt can be appropriately changed.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. An imaging system comprising:
an endless belt to convey a printing medium;
a tensioning member to tension the endless belt, the tensioning member to rotate about an axis;
a heating member located adjacent the endless belt to heat the endless belt;
a pressing member to press the endless belt against the heating member; and
a cleaning member, located outside the endless belt, between the tensioning member and the heating member, to press the endless belt inwardly,
wherein the cleaning member extends in an extension direction of the axis of the tensioning member and is tiltable with respect to the extension direction of the axis.

2. The imaging system according to claim 1,
wherein the cleaning member is to rotate along a movement direction of the endless belt, and
wherein a rotation speed of the cleaning member is different from a movement speed of the endless belt.

3. The imaging system according to claim 1,
wherein the cleaning member is to rotate along a movement direction of the endless belt, and
wherein a rotation speed of the cleaning member is adjustable.

4. The imaging system according to claim 1, wherein the cleaning member is disposed at a lower side of the endless belt in a direction of gravity.

5. The imaging system according to claim 1, comprising:
a first gear connected to the tensioning member; and
a second gear connected to the cleaning member, the second gear to engage with the first gear,
wherein the tensioning member is a rotatable tension roller, and
wherein a number of teeth of the second gear is different from a number of teeth of the first gear.

6. The imaging system according to claim 1, wherein the cleaning member is operable to contact the endless belt and to separate from the endless belt.

7. The imaging system according to claim 1, comprising:
an image density acquiring unit to acquire image density of an image surface of the printing medium having a toner image fixed thereto,
wherein the cleaning member is operable to contact the endless belt when the image density acquired by the image density acquiring unit is a predetermined value or more and to separate from the endless belt when the image density acquired by the image density acquiring unit is less than the predetermined value.

8. An imaging system comprising:
an endless belt to convey a printing medium;
a tensioning member to tension the endless belt;
a heating member located adjacent the endless belt to heat the endless belt;
a pressing member to press the endless belt against the heating member; and
a rotatable cleaning roller located outside the endless belt, between the tensioning member and the heating member, the cleaning roller to press the endless belt inwardly,
wherein the endless belt includes an outer surface having a contact region that is in contact with a surface of the cleaning roller, and
wherein the contact region extends in a rotational direction of the cleaning roller, the contact region having a first end and a second end opposite the first end in the rotational direction, and wherein a first line connecting the first end of the contact region with a center of the cleaning roller forms an angle with a second line connecting the second end of the contact region with the center of the cleaning roller, wherein the angle is greater than 0° and equal to or less than 90°.

9. The imaging system according to claim 8, wherein the cleaning roller is movable with respect to the endless belt, and wherein the angle between the first line and second line is changeable by moving the cleaning roller, in order to adjust a pressing amount of the cleaning roller against the endless belt.

10. The imaging system according to claim 8, wherein the surface of the cleaning roller has an adhesion characteristic that is greater than an adhesion characteristic of the outer surface of the endless belt, to cause a foreign matter sandwiched between the cleaning roller and the endless belt in the contact region of the endless belt, to adhere to the surface of the cleaning roller when the foreign matter reaches an exit of the contact region where the endless belt is separated from the cleaning roller.

11. The imaging system according to claim 8, wherein the cleaning roller is to rotate along a movement direction of the endless belt, and wherein a rotation speed of the cleaning roller is different from a movement speed of the endless belt.

12. The imaging system according to claim 8, wherein the cleaning roller is to rotate along a movement direction of the endless belt, and wherein a rotation speed of the cleaning roller is adjustable.

13. The imaging system according to claim 8, wherein the cleaning roller is disposed at a lower side of the endless belt in a direction of gravity.

14. The imaging system according to claim 8, comprising:

a first gear connected to the tensioning member; and a second gear connected to the cleaning roller, the second gear to engage with the first gear, wherein the tensioning member is a rotatable tension roller, and wherein a number of teeth of the second gear is different from a number of teeth of the first gear.

15. The imaging system according to claim 8, wherein the cleaning roller is operable to contact the endless belt and to separate from the endless belt.

16. The imaging system according to claim 15, wherein a nip portion is formed where the endless belt contacts both the heating member and the pressing member, and wherein the cleaning roller is operable to contact the endless belt when the printing medium does not pass through the nip portion and to separate from the endless belt when the printing medium passes through the nip portion.

17. The imaging system according to claim 15, comprising:

an image density acquiring unit to acquire image density of an image surface of the printing medium having a toner image fixed thereto, wherein the cleaning roller is operable to contact the endless belt when the image density acquired by the image density acquiring unit is a predetermined value or more and to separate from the endless belt when the image density acquired by the image density acquiring unit is less than the predetermined value.

18. The imaging system according to claim 8, wherein the tensioning member is a tension roller which is rotatable about an axis, wherein the cleaning roller extends in an extension direction of the axis of the tension roller, and wherein the cleaning roller is tiltable with respect to the extension direction of the axis.

19. An imaging system comprising:

an endless belt to convey a print media having a toner image, the endless belt having an inner surface and an outer surface opposite the inner surface;

a fixing assembly to fix the toner image on the print media, the fixing assembly comprising a heating member adjacent the endless belt, and a pressure member to press the endless belt against the heating member;

a tension member engaging the inner surface of the endless belt to tension the endless belt;

a cleaning member to contact the outer surface of the endless belt, wherein the cleaning member is positioned between the tension member and the fixing assembly to form a concave portion of the endless belt about the cleaning member; and an image density acquiring unit to acquire image density of an image surface of the print media having a toner image fixed thereto, wherein the cleaning member is operable to contact the endless belt when the image density acquired by the image density acquiring unit is a predetermined value or more and to separate from the endless belt when the image density acquired by the image density acquiring unit is less than the predetermined value.

20. The imaging system according to claim 19, wherein the cleaning member comprises a cleaning roller having a circumferential surface including a curved contact portion that is in contact with the outer surface of the endless belt, and wherein the cleaning roller is to rotate at a rotational speed that causes the cleaning roller to slide relative to the endless belt.

* * * * *